US009620103B2

(12) United States Patent
Doshi

(10) Patent No.: US 9,620,103 B2
(45) Date of Patent: Apr. 11, 2017

(54) METHOD FOR NOISE CANCELLATION

(71) Applicant: Uma Satish Doshi, Portland, OR (US)

(72) Inventor: Uma Satish Doshi, Portland, OR (US)

(73) Assignee: Doshi Research, LLC, Portland, OR (US)

( * ) Notice: Subject to any disclaimer, the term of this patent is extended or adjusted under 35 U.S.C. 154(b) by 0 days.

(21) Appl. No.: 14/552,247

(22) Filed: Nov. 24, 2014

(65) Prior Publication Data

US 2016/0098982 A1 Apr. 7, 2016

Related U.S. Application Data

(60) Provisional application No. 62/071,818, filed on Oct. 3, 2014.

(51) Int. Cl.
*G10K 11/175* (2006.01)
*G10K 11/178* (2006.01)

(52) U.S. Cl.
CPC .. *G10K 11/1788* (2013.01); *G10K 2210/1081* (2013.01); *G10K 2210/3214* (2013.01)

(58) Field of Classification Search
CPC .... G10K 11/002; G10K 11/16; G10K 11/175; G10K 11/178; G10K 11/1782; G10K 11/1784; G10K 2210/1081; G10K 2210/30231; G10L 21/0208; G10L 2021/02165; H03G 3/24; H04R 1/1083; H04R 2460/01
See application file for complete search history.

(56) References Cited

U.S. PATENT DOCUMENTS 6,259,792 B1 * 7/2001 Lambrecht ..... H04R 5/02 381/71.13
6,363,345 B1 * 3/2002 Marash ..... G10L 25/78 704/205
7,567,677 B1 * 7/2009 Chan ..... G06F 1/1616 381/71.1
8,374,356 B2 * 2/2013 Kino ..... G10K 11/178 381/71.2
2003/0016833 A1 * 1/2003 Harvey ..... G10K 11/1784 381/71.5
2005/0238179 A1 * 10/2005 Erdmann ..... G10K 11/1788 381/71.4
2005/0254664 A1 * 11/2005 Kwong ..... G10K 11/1788 381/71.2
2012/0177213 A1 * 7/2012 Le Faucheur ..... G10K 11/1784 381/71.6
2013/0301846 A1 * 11/2013 Alderson ..... H04R 3/002 381/71.7

(Continued)

*Primary Examiner* — Brenda Bernardi
(74) *Attorney, Agent, or Firm* — Portland Intellectual Property, LLC

(57) ABSTRACT

A method for noise cancellation. The method includes providing a sound signal output device having a listening device output, a microphone input, and signal processing circuitry. The signal processing circuitry is adapted for causing the sound signal output device to perform in a noise-cancellation mode, including making available to the sound signal output device, at the microphone input, a noise-containing signal which is representative of ambient acoustical noise, deriving a noise-cancelling signal from the noise-containing signal, and making available to the personal listening device, at the listening device output, the noise-cancelling signal.

27 Claims, 1 Drawing Sheet

(56) References Cited

U.S. PATENT DOCUMENTS

| | | | | |
|---|---|---|---|---|
| 2014/0050330 | A1* | 2/2014 | Allen | H04R 3/00 381/74 |
| 2014/0270220 | A1* | 9/2014 | Bieler | G10K 11/1788 381/71.4 |
| 2015/0003622 | A1* | 1/2015 | Lee | H04R 1/1033 381/71.6 |
| 2015/0055789 | A1* | 2/2015 | Bernal Castillo | G10K 11/178 381/71.6 |
| 2015/0294662 | A1* | 10/2015 | Ibrahim | G10K 11/178 381/71.6 |

* cited by examiner

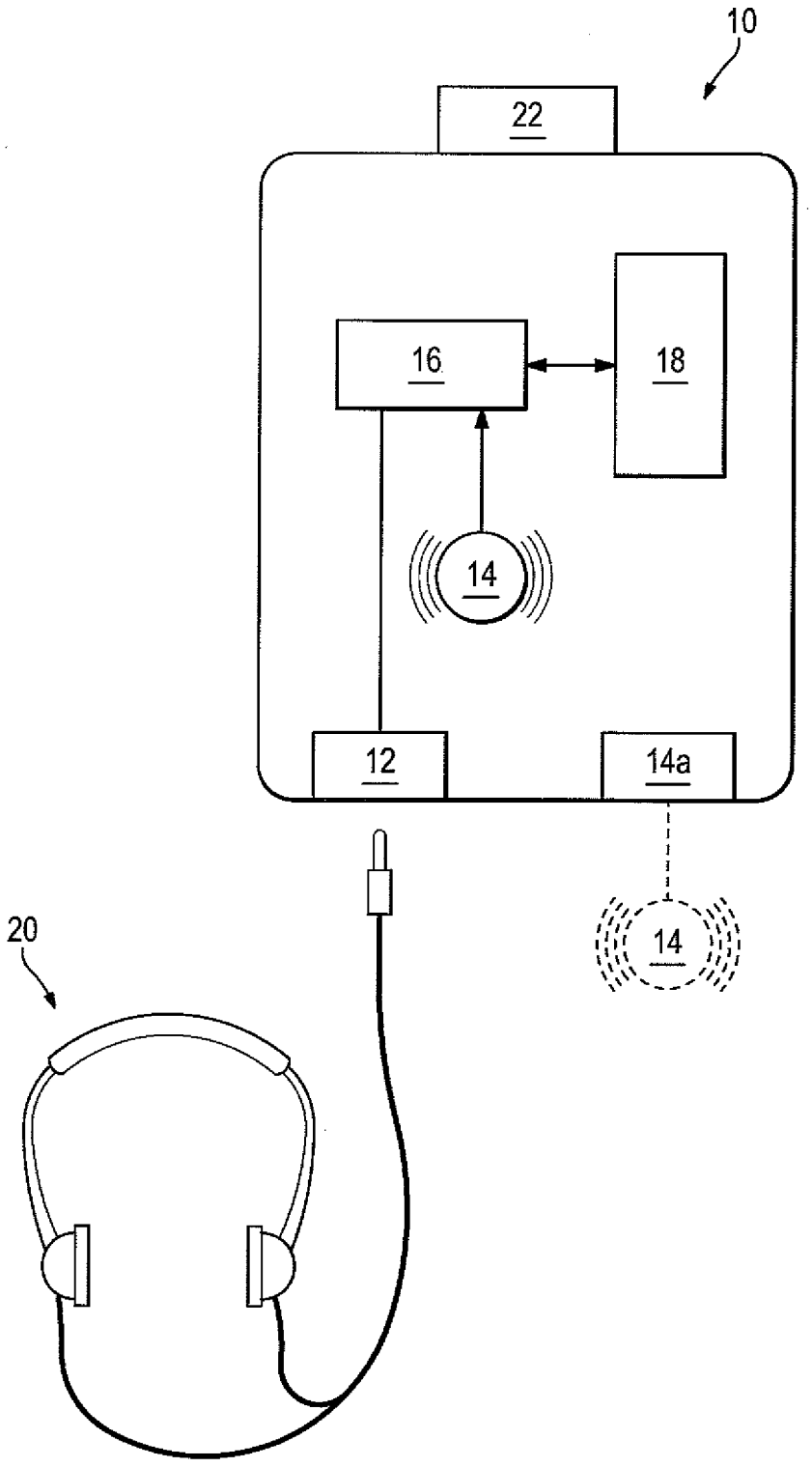
10
22
16
18
14
12
14a
14
20

METHOD FOR NOISE CANCELLATION

RELATED APPLICATIONS

The present application claims the benefit of U.S. provisional application Ser. No. 62/071,818 the disclosure of which is incorporated by reference herein in its entirety.

FIELD OF THE INVENTION

The present invention relates to a method for noise cancellation, particularly for use with headphones, earphones, headsets or earsets.

BACKGROUND

Noise-cancelling headphones have been commercially available for many years, to provide personal listening environments in which ambient acoustical noise is reduced at the listener's ears by cancelling, as opposed to insulating the listener from, the noise.

Like ordinary headphones, noise-cancelling headphones are adapted to be plugged into devices that output, into the headphones, desired electrical signals representative of sounds such as music or speech that are of interest to the listener, the desired electrical signals having been amplified sufficiently in the device to drive the speakers in the headphones. For example, headphones can be connected to smartphones, for listening to music that is being streamed to the smartphone, or which has been downloaded to the smartphone.

The noise-cancelling process is also known as active noise reduction or active noise control. The process includes sampling the ambient acoustical noise, producing a noise-containing electrical signal representative thereof, and transforming the noise-containing electrical signal into a noise-cancelling electrical signal by phase shifting the sinusoidally varying Fourier components of the noise-containing electrical signal substantially 180 degrees. The noise-cancelling electrical signal is then superimposed on a desired electrical signal representing music, speech, or other sounds of interest to the listener, such as may be transmitted to a device to which the noise-cancelling headphones are connected, such as a digital music player or a smartphone. The resultant electrical signal is amplified and used to drive the speakers in the headphones in place of the desired electrical signal. The resultant electrical signal is more advantageous for driving the headphones than the desired electrical signal because it is adapted to compensate for the acoustical noise whereas the desired electrical signal is not.

A microphone or equivalent sound transducer (hereinafter "microphone") is required for sampling the acoustical noise, and electrical circuitry that typically includes an analog-to-digital converter (ADC), microprocessor, and a programmed or programmable memory for storing a program of instructions for the processor, transforms the noise-containing electrical signal into the noise-cancelling electrical signal.

In the prior art, the microphone and electrical circuitry is provided in the noise cancelling headphones, rendering them specialty items that are typically provided at higher cost. It is an objective of the present invention to provide for the same or similar noise-cancellation at a lower cost.

SUMMARY

A method for noise cancellation is disclosed herein for providing noise cancellation in a personal listening device, such as a pair of headphones. The method includes providing a sound signal output device, such as a smartphone, having a listening device output, a microphone input, and signal processing circuitry. The signal processing circuitry is adapted for causing the sound signal output device to perform in a noise-cancellation mode, including making available to the sound signal output device, at the microphone input, a noise-containing signal which is representative of ambient acoustical noise, deriving a noise-cancelling signal from the noise-containing signal, and making available to the personal listening device, at the listening device output, the noise-cancelling signal.

The noise-cancelling signal may be capable of destructively interfering with the noise-containing signal such that a superposition of the noise-cancelling signal and the noise-containing signal would contain at least 50% less power than the noise-containing signal.

The personal listening device may be connected to the listening device output of the sound signal output device, either by making a wireless connection between the personal listening device and the sound signal output device, or by inserting a plug that is connected to one of the personal listening device and the sound signal output device into a jack that is connected to the other one of the personal listening device and the sound signal output device.

A desired signal representing selected music or speech may be superimposed on the noise-cancelling signal at the listening device output of the sound signal output device.

According to another aspect of the invention, the method includes sampling ambient acoustical noise that has occurred or is occurring over a time interval T1 to produce a noise-containing signal, accessing library data representative of ambient acoustical noise that has occurred over a time interval T2 which precedes the time interval T1, and combining the library data with the sampled acoustical data for producing the noise-cancelling signal.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

BRIEF DESCRIPTION OF DRAWINGS

The FIGURE is a block diagram of a system for noise cancellation according to the present invention.

DETAILED DESCRIPTION OF PREFERRED EMBODIMENTS

As used herein, the term "earphone" refers to a transducer which converts electrical signals to sound waves, where at least a portion of the transducer is adapted to be placed in the ear(s); the term "earset" refers to an earphone that includes a microphone; the term "headphone" refers to such a transducer adapted to be placed over the ear(s); and the term "headset" refers to a headphone that includes a microphone. As used herein, the term "personal listening device" will refer to any of the above transducers.

Personal listening devices are electrically connected to electronic devices that output electrical signals to the personal listening devices which are representative of sounds such as music and speech of interest to or for the enjoyment of a listener. For example and without limitation, personal listening devices may be connected to music players, televisions, computers, and cellular (a.k.a. mobile) phones. Digital cellular phones include "smartphones," which include, along with the features of a mobile phone, features provided in handheld computers or "personal digital assistant" devices (PDAs), including the ability to download and store data, such as music, from. Internet websites. Hereinafter the term "sound signal output device" will refer broadly to any of such electronic devices.

Sound signal output devices can be either analog or digital, but they are typically digital and so the discussion herein will focus on digital sound signal output devices, it being understood that there is no intention to exclude analog sound signal output devices from the ambit of the invention.

A sound signal output device is typically adapted for removable connection to a personal listening device, either by virtue of having a "jack," commonly referred to as a headphone jack or phone jack, for receiving a "plug," commonly referred to as a headphone plug or phone plug, which is connected by a length (e.g., 3 feet) of electrical cable to the personal listening device, or by virtue of being adapted for wireless electrical connection to the personal listening device.

The term "listening device output" will refer generally to a location on or in the sound signal output device at which a signal that is ready for output to the personal listening device is normally made available to the personal listening device.

The sound signal output device may have a built-in microphone, or it may be adapted to removably receive an external microphone, either by virtue of having a microphone input jack, for receiving a microphone plug, or by virtue of being adapted for wireless electrical connection to the microphone. The term "microphone input" will refer generally to a location on or in the sound signal output device at which a signal produced by a microphone is normally made available to the sound signal output device.

It should be understood that the terms "electrical signals" and "electrical circuitry" are not intended to be exclusive of any known equivalents, such as optical signals and circuitry, or signals and circuitry based on quantum-mechanical phenomena. In accord with this understanding, the term "connected" as used herein includes connections that allow for communication through any such signals.

The present inventor has recognized that any sound signal output device, such as virtually any modem cellular phone, that has a listening device output, a microphone or microphone input, and electrical circuitry that includes an analog-to-digital converter (ADC) for converting electrical signals from the microphone to digital electrical signals, a processor, and a memory for storing programs of instruction for the processor, can be inexpensively modified to provide for noise-cancellation in the personal listening device by providing additional software in the sound signal output device for producing the aforementioned noise-cancelling electrical signal and superimposing it on the desired electrical signal at the personal listening device output for use by the personal listening device.

The present inventor has also recognized that any sound signal output device that is commercially produced in large quantities, such as a cellular phone, that has a listening device output and a microphone or microphone input, can be relatively inexpensively provided with hardware for producing the aforementioned noise-cancelling electrical signal and superimposing it on the desired electrical signal at the personal listening device output for use by the personal listening device, as compared with the cost of providing the same hardware in a lower volume specialty device like a pair of noise-cancelling headphones.

It should be understood that by describing the invention below in terms of a software implementation, the invention is not limited to software implementations, and may be implemented in hardware or any combination of software and hardware as desired.

The FIGURE shows a sound signal output device 10 that employs a software implementation of the invention. The device 10 includes a standard phone jack 12, a microphone 14 that is either built-in as shown, or connected to a microphone jack 14*a*, and a processor 16 for, among other things, receiving analog signals from the microphone 14, converting the signals to digital form, and processing the digital signals. The processor 16 also converts processed digital signals, which may or may not have originated from the microphone, to analog form for output to the phone jack 12. The processor is typically though not necessarily a digital signal processor (DSP) or a general purpose microprocessor; and the device 10 typically though not necessarily includes a memory 18 which may be used to store both programs and data for use by the processor 16.

A personal listening device 20 is shown adapted for plugging into the phone jack 12, to connect the personal listening device to the sound signal output device 10.

The desired electrical signal, to which the listener desires to listen by use of the personal listening device 20, may be input to the sound signal output device 10, or produced within the sound signal output device, in a number of different ways. For example, the desired electrical signal may be a digital broadcast signal that is transmitted to the sound signal output device by a cellular transmitter and received by a receiver 22 in the sound signal output device; the desired electrical signal may be produced within the sound signal output device by streaming data from the memory 18, such as data that have been downloaded to the device from an Internet website; or the desired electrical signal may be data that are streamed, such as from an Internet web site, to the sound signal output device without storing the data in the memory.

The desired electrical signal is typically digital, and is transformed into analog form by the processor 16 or a separate digital to analog converter (DAC) for output to the phone jack 12. The noise-containing electrical signal is produced by the microphone and is therefore typically analog, and is transformed into digital form by the processor 16 or a separate ADC for processing.

According to the invention, the memory 18 may be modified, temporarily or permanently, to include a program of instructions for the processor 16, for causing the device 10 to perform in a "noise-cancellation" mode of the device. In such noise-cancellation mode, the microphone 14 is used for sampling the ambient acoustical noise, at any desired rate which may but typically need not be 100%, and producing a noise-containing electrical signal representative thereof. The noise-containing electrical signal is transformed into digital form for processing so as to produce a digital noise-cancelling electrical signal, which is transformed into analog form and superimposed on the desired electrical signal for output to the phone jack 12.

The digital noise-cancelling electrical signal may be produced from the digital noise-containing electrical signal using any signal processing algorithms desired, known or used to provide noise-cancellation. Such algorithms share a common feature that they include steps corresponding in the analog domain to phase shifting sinusoidally varying Fourier components of the noise-containing electrical signal substantially 180 degrees, which may be referred to as "inverting the noise-containing electrical signal," so that superimposing the two electrical signals results in destructive interference so as to produce a reduction in the power contained in the noise-containing electrical signal of at least 50%.

Likewise, transforming the noise-cancelling electrical signal into a corresponding noise-cancelling sound wave, and superimposing the noise-cancelling sound wave on the ambient acoustical noise from which the noise-cancelling sound wave was derived, results in destructive interference so as to produce a reduction in the power contained in the ambient acoustical noise of at least 50%.

Also according to the invention, the memory 18 may be further modified to include a library of stored noise data associated with known, normally, or frequently encountered acoustical noise, such as the cabin noise in a particular make and model of aircraft produced by the aircraft's engines while the aircraft is in flight. Such stored acoustical noise data, after being streamed as an electrical signal and synchronized with actual ambient acoustical noise sampled by the microphone 14, may be superimposed on, used as a basis for modifying, or used in place of, a noise-containing electrical signal obtained by sampling the actual ambient acoustical noise.

As an example of using acoustical noise data from the library to modify the electrical signal obtained by sampling actual ambient acoustical noise, one or both of the electrical signal derived from the library data and the electrical signal derived from the actual acoustical noise may be first filtered to emphasize or de-emphasize the power of the signal at certain frequencies, and then superimposed.

The present inventor has also recognized that anything worn in the ear, and especially any personal listening device adapted to cover the ear such as headphones, provides for some degree of sound insulation from the ambient acoustical noise. Thus the ambient acoustical noise heard by the listener while using the personal listening device will in general be different from the ambient acoustical noise as it is sampled at the microphone. The sound insulation will typically decrease the magnitude and delay the phase of each frequency component of the ambient acoustical noise, by frequency dependent amounts, i.e., it will have an acoustical transfer function or system function that is not unity.

However, this deviation in the acoustical transfer function from unity can be compensated for by suitable equalization. Such equalization may be applied to the noise-containing electrical signal, or any one or more electrical signals derived from the noise-containing electrical signal upon which the noise-cancelling electrical signal is based, including the noise-cancelling electrical signal itself. Such equalization may be accomplished by boosting the magnitudes of selected individual frequency components of the chosen electrical signal(s) relative to other components, or equivalently by decreasing the magnitudes of the latter relative to the former, and which may include delaying the phases of the components sufficiently to equalize their phase delays.

The acoustical transfer function may be determined by exposing the personal listening device to acoustical noise over a selected frequency range of concern, e.g., the full range of normal human hearing, or a range of frequencies which the personal listening device is capable of reproducing within predetermined outer limits of distortion, measuring the magnitude of the noise, both outside the personal listening device and inside the personal listening device at the listener's ear, as a function of frequency, and comparing the measurements for all, or a selected portion, of the frequencies within the selected range.

Preferably, the acoustical transfer function of the personal listening device is predetermined and a suitable equalization algorithm is included in the memory 18 at the factory for compensating the noise-cancelling electrical signal to account for the distortion of the ambient acoustical noise produced by the insulation of the personal listening device 10.

Alternatively, the sound signal output device may be adapted to provide the listener the capability to perform customized equalization, as the listener desires or is able to determine to be most effective for cancelling the ambient acoustical noise while maintaining fidelity to the desired electrical signal. If the sound signal output device has a display, such as a smartphone or PDA, it may be provided with a graphical user interface to emulate the linear or rotary potentiometers commonly provided in dedicated, hard-wired hi-fi equalizers.

Noise-cancellation can be provided according to the invention whether the sound signal output device is being used merely to transmit sounds to a user of the device, such as to play music, or to receive sounds produced or otherwise input by the user, such as when it is used as a phone. However, if the sound signal output device is used as a phone, it is a potential problem that the sounds produced or otherwise input to the sound signal output device by the user will be picked up by the microphone and treated by the sound signal output device to be ambient acoustical noise to be cancelled if no steps are taken to avoid that result.

So, according to the invention, when the sounds produced or otherwise input to the sound signal output device by the user are human speech, noise-cancellation as provided by the invention may be adapted to avoid cancelling sounds in the frequency range of human speech. This will often have acceptably minimal impact on the ability of the device 10 to provide noise-cancellation of ambient acoustical noise because human speech occupies a relatively narrow range of frequencies, and because it is not necessary to cancel noise when the person using the personal listening device is speaking and, therefore (at least typically), not listening.

According to the same principle, the personal listening device 10 may be adapted to provide a user of the device the capability to pass user-selected frequency bands of ambient acoustical sound that the user does not want the device to cancel, which the user wants a party, with whom the user is using the personal listening device to communicate, to hear. Such frequency bands may be identified by commonly known sounds falling within their ranges, so that the user need not be familiar with the frequency content of those sounds.

Alternatively, noise-cancellation according to the invention can be suspended during those time intervals when the ambient acoustical noise is determined to include a relatively high frequency content within the range of human speech, or it may be suspended during times the user is known or can be determined to be using the device to send sound(s) to a party with whom the user is using the personal listening device 10 to communicate, or during any times the user specifies.

All of the above described features may typically be provided simply by adding a suitable program of instructions to the personal listening device. Such programs may be provided as permanent parts of the memory 18, or they may be downloaded to the memory for temporary storage as desired by the user, such as an app.

Noise-cancellation can be improved according to the invention by providing multiple spaced apart microphones in the sound signal output device, to provide for multi-point sampling of the noise.

It is to be understood that, while a specific method and system for noise cancellation has been shown and described as preferred, variations may be employed without departing from the principles of the invention, and that the scope of the invention is defined and limited only by the claims which follow.

The invention claimed is:

1. A method for providing noise cancellation in a personal listening device, comprising:

providing a sound signal output device having a listening device output, a microphone input, and signal processing circuitry adapted for causing the sound signal output device to perform in a noise-cancellation mode, including making available to the sound signal output device, at the microphone input, a noise-containing signal which is representative of ambient acoustical noise, and deriving a noise-cancelling signal from the noise-containing signal at least in part by inverting the noise-containing signal;

compensating the noise-cancelling signal for the acoustical transfer function of the personal listening device by equalization;

superimposing the equalized noise-cancelling signal and the noise-containing signal to produce a resulting signal; and providing the resulting signal to the personal listening device.

2. The method of claim 1, further comprising connecting the personal listening device to the listening device output of the sound signal output device, either by making a wireless connection between the personal listening device and the sound signal output device, or by inserting a plug that is connected to one of the personal listening device and the sound signal output device into a jack that is connected to the other one of the personal listening device and the sound signal output device.

3. The method of claim 2, further comprising representing selected music or speech by a desired signal and superimposing the desired signal on the noise-cancelling signal at the listening device output of the sound signal output device.

4. The method of claim 1, further comprising representing selected music or speech by a desired signal and superimposing the desired signal on the noise-cancelling signal at the listening device output of the sound signal output device.

5. The method of claim 4, further comprising:

sampling ambient acoustical noise that has occurred or is occurring over a time interval T1 to produce a noise-containing signal;

accessing library data representative of ambient acoustical noise that has occurred over a time interval T2 which precedes the time interval T1;

synchronizing the library data with the sampled ambient acoustical noise; and combining the library data with the sampled acoustical noise for producing the noise-cancelling signal.

6. The method of claim 3, further comprising:

sampling ambient acoustical noise that has occurred or is occurring over a time interval T1 to produce a noise-containing signal;

accessing library data representative of ambient acoustical noise that has occurred over a time interval T2 which precedes the time interval T1;

synchronizing the library data with the sampled ambient acoustical noise; and combining the library data with the sampled acoustical noise for producing the noise-cancelling signal.

7. The method of claim 2, further comprising:

sampling ambient acoustical noise that has occurred or is occurring over a time interval T1 to produce a noise-containing signal;

accessing library data representative of ambient acoustical noise that has occurred over a time interval T2 which precedes the time interval T1;

synchronizing the library data with the sampled ambient acoustical noise; and combining the library data with the sampled acoustical noise for producing the noise-cancelling signal.

8. The method of claim 1, further comprising:

sampling ambient acoustical noise that has occurred or is occurring over a time interval T1 to produce a noise-containing signal;

accessing library data representative of ambient acoustical noise that has occurred over a time interval T2 which precedes the time interval T1;

synchronizing the library data with the sampled ambient acoustical noise; and combining the library data with the sampled acoustical noise for producing the noise-cancelling signal.

9. A method for providing noise-cancellation, comprising:

sampling ambient acoustical noise that has occurred or is occurring over a time interval T1 to produce a noise-containing signal;

accessing library data representative of ambient acoustical noise that has occurred over a time interval T2 which precedes the time interval T1;

synchronizing the library data with the sampled ambient acoustical noise; and combining the library data with the sampled acoustical noise for producing a noise-cancelling signal that is derived, at least in part, by inverting the noise-containing signal.

10. The method of claim 9, wherein the step of compensating includes providing an equalization algorithm in the sound signal output device that has been predetermined for the personal listening device.

11. The method of claim 8, wherein the step of compensating includes providing an equalization algorithm in the sound signal output device that has been predetermined for the personal listening device.

12. The method of claim 7, wherein the step of compensating includes providing an equalization algorithm in the sound signal output device that has been predetermined for the personal listening device.

13. The method of claim 6, wherein the step of compensating includes providing an equalization algorithm in the sound signal output device that has been predetermined for the personal listening device.

14. The method of claim 5, wherein the step of compensating includes providing an equalization algorithm in the sound signal output device that has been predetermined for the personal listening device.

15. The method of claim 4, wherein the step of compensating includes providing an equalization algorithm in the sound signal output device that has been predetermined for the personal listening device.

16. The method of claim 3, wherein the step of compensating includes providing an equalization algorithm in the sound signal output device that has been predetermined for the personal listening device.

17. The method of claim 2, wherein the step of compensating includes providing an equalization algorithm in the sound signal output device that has been predetermined for the personal listening device.

18. The method of claim 1, wherein the step of compensating includes providing an equalization algorithm in the sound signal output device that has been predetermined for the personal listening device.

19. The method of claim 9, wherein the sound signal output device is adapted for user-customized equalization.

20. The method of claim 8, wherein the sound signal output device is adapted for user-customized equalization.

21. The method of claim 7, wherein the sound signal output device is adapted for user-customized equalization.

22. The method of claim 6, wherein the sound signal output device is adapted for user-customized equalization.

23. The method of claim 5, wherein the sound signal output device is adapted for user-customized equalization.

24. The method of claim 4, wherein the sound signal output device is adapted for user-customized equalization.

25. The method of claim 3, wherein the sound signal output device is adapted for user-customized equalization.

26. The method of claim 2, wherein the sound signal output device is adapted for user-customized equalization.

27. The method of claim 1, wherein the sound signal output device is adapted for user-customized equalization.

* * * * *